US005985393A

United States Patent [19]

Akahoshi et al.

[11] Patent Number: 5,985,393

[45] **Date of Patent: *Nov. 16, 1999**

[54] HEAT INSULATING BOX

[75] Inventors: Sumihisa Akahoshi; Yutaka Igarashi; Kouji Hirata, all of Yamaguchi-ken; Masanori Tsujihara, Hyogo-ken; Fumiaki Baba, Hyogo-ken; Akira Yamada, Hyogo-ken; Chisa Kato, Hyogo-ken, all of Japan

[73] Assignees: Mitsubishi Denki Kabushiki Kaisha; Ube Cycon, Ltd., both of Tokyo, Japan

[ * ] Notice: This patent is subject to a terminal disclaimer.

[21] Appl. No.: 08/888,532

[22] Filed: Jul. 7, 1997

Related U.S. Application Data

[63] Continuation of application No. 08/348,484, Dec. 2, 1994, Pat. No. 5,707,700, which is a continuation of application No. 08/016,109, Feb. 10, 1993, abandoned.

[30] Foreign Application Priority Data

| | | | |
|---|---|---|---|
| Feb. 14, 1992 | [JP] | Japan | 4-28034 |
| Jul. 30, 1992 | [JP] | Japan | 4-203416 |
| Nov. 5, 1992 | [JP] | Japan | 4-295546 |

[51] Int. Cl.[6] ..... B29D 22/00

[52] U.S. Cl. ..... 428/36.8; 428/35.7; 428/36.5; 428/421; 428/424.2; 428/425.8

[58] Field of Search ..... 428/35.7, 36.5, 428/36.8, 36.9, 421, 424.2, 425.8, 36.91

[56] References Cited

U.S. PATENT DOCUMENTS

| | | | |
|---|---|---|---|
| 5,229,457 | 7/1993 | Kamoshita et al. | 525/71 |
| 5,248,546 | 9/1993 | Greenlee | 428/212 |
| 5,707,700 | 1/1998 | Akahoshi et al. | 428/36.8 |

*Primary Examiner*—S. Mark Clardy
*Assistant Examiner*—Michael A. Williamson
*Attorney, Agent, or Firm*—Leydig, Voit & Mayer, Ltd.

[57] ABSTRACT

A heat insulating box, such as a refrigerator box, comprises a heat insulator and a box member that is in contact with the heat insulator. The heat insulator is formed of a urethane foam using either HCFC-123 ($CHCl_2CF_3$) or HCFC-141b ($CH_3CCl_2F$) or both as a forming agent, and the box member is formed of a styrene/acrylonitrile/butadiene terpolymer, a styrene/ethylene-α-olefinic rubbery copolymer/acrylonitrile terpolymer (AES resin), a styrene/alkyl acrylate ester containing rubbery copolymer/acrylonitrile terpolymer (AAS resin), or a mixture of the AES resin and the AAS resin.

8 Claims, 1 Drawing Sheet

HEAT INSULATING BOX

This application is a continuation of Ser. No. 08/348,484 filed Dec. 2, 1994, now U.S. Pat. No. 5,707,700 which is a continuation of Ser. No. 08/016,109 filed Feb. 10, 1993 now abandoned.

BACKGROUND OF THE INVENTION

This invention relates to a heat insulating box that uses a urethane foam as a heat insulator.

A refrigerator box is a kind of heat insulating boxes and its general construction and method of production are described below with reference to "Handbook of Polyurethane Resins", published by the Nikkan Kogyo Shimbun, Ltd., pp.238–243 and pp.248–250 and "Plastics Market and Product Design-Electric and Electronic Devices", published by Plastics Age Co., Ltd. pp.58–67. FIG. 1 is a perspective view of a typical refrigerator box, and FIG. 2 is a cross section of that refrigerator box. Shown by 1 is an outer box, 2 is an inner box, and 3 is a urethane foam as a heat insulator. Outer box 1 may typically be produced by molding a painted or coated steel sheet into a predetermined shape (e.g. a gate in the normal or inverted position). Then, an inner box 2 also molded into a predetermined shape is combined with the outer box 1 and a liquid urethane stock from which a heat insulator urethane foam 3 is to be made is injected into the gap between the two boxes. The liquid urethane stock is subsequently foamed so that the outer box 1 is joined integrally with the inner box by means of the foamed urethane 3, which serves not only as a heat insulator but also as a member to retain the strength of the overall structure. Depending on the object of use, the outer box may be made of the same material as the inner box.

During foaming, the polyurethane which undergoes curing reaction will generate heat and the center of the urethane foam 3 will become as hot as 60° C. and above. Hence, following the curing reaction of polyurethane, the urethane foam 3 will cool to shrink, developing a shrinkage stress. The stress causes distortion in the urethane foam 3 or inner box 2 and, if the material of the inner box does not have adequate strength, blushing or cracking will occur in the inner box. To avoid those problems, the material of the inner box must have good moldability, exhibit good adhesion to the urethane foam 3 and high resistance to the stress that may develop upon shrinkage at cold temperature; in addition, said material must satisfy other conditions such as high resistance to the impact of an article dropping in the refrigerator, as well as high resistance to chemicals that may contaminate the interior of the refrigerator such as edible oils and seasonings. Materials in current use that are said to satisfy those requirements include ABS resins (acrylonitrile-butadiene-styrene terpolymers), butadiene rubber containing styrene resins, and vinyl chloride resins (PVC).

As forming agents for the urethane foam 3, Freon CFC-11 ($CCl_3F$) is most commonly used since it has a good balance between heat insulating property, toxicity, safety, ease of handling and cost. CFC-11 is mixed in liquid form in the starting materials of polyurethane and during foaming, it is evaporated by the heat of reaction of urethane resin to form tiny cells. As time passes, CFC-11 will come out of the foam cells and diffuse to the ambient. Hence, the inner box 2 is subject to the action of CFC-11 not only during the injection of the starting materials of polyurethane but also by its diffusion out of the cells after completion of foaming. Styrene resins currently used to make the inner box have low resistance to CFC-11 and require a protective film or coat in order to avoid direct contact with the foam 3. Vinyl chloride resins (PVC) are less subject to the action of CFC-11 but, on the other hand, they have such low resistance to heat that they may deform upon exposure to heat that will be generated when the insulating material 3 undergoes reaction; furthermore, vinyl chloride resins are so low impact resistance that they are prone to crack. ABS resins are used most extensively today since they have a good balance between various properties such as moldability, stress relaxation upon shrinkage at cold temperature, impact resistance, solvent resistance and resistance to CFC-11.

With the recent concern over the depletion of ozone layers in the stratosphere, many countries have started to introduce global regulations on the production and consumption of Freons. CFC-11 is also within the class of materials under such regulation and the increasing difficulty in using it as a foaming agent for heat insulating polyurethane foams has necessitated the development of a substitute foaming agent. Available as such substitutes today are HCFC-123 ($CHCl_2CF_3$) and HCFC-141b ($CH_3CCl_2F$) which are similar to CFC-11 in physical properties (e.g. boiling point and the latent heat of evaporation) and which are out of the scope of the applicable regulations.

However, compared to CFC-11, the substitutes HCFC-123 and HCFC-141b have great tendency to dissolve polymeric materials and their ability to swell and dissolve butadiene rubber containing styrene resins and ABS resins which are currently used as materials for making boxes is so great that using them as foaming agents in place of CFC-11 will not only lower the strength of boxes but also lead to their destruction or deterioration in appearance. If HCFC-123 and HCFC-141b are used as foaming agents for the polyurethane foam, ABS resins which are most commonly used today as box making materials suffer from the problem that they are so seriously attacked by the foaming agents that cracks will develop in the box. To avoid this problem, it has been attempted to increase the wall thickness of the box making materials by a great degree or to laminate them with a film that exhibits high resistance to HCFC-123 and HCFC-141b. In practice, however, these techniques have not proved to be completely satisfactory. Even if the wall thickness of the box making materials is increased, they will be affected by HCFC over time and, in the long run, the quality of the refrigerator box will deteriorate. Furthermore, thicker sheets either require a longer molding time to reduce the production rate or result in heavier box making materials and, hence, heavier refrigerator boxes. On the other hand, lamination with materials having high HCFC resistance is indeed effective in preventing the attack of HCFC by the necessary minimum thickness of box making materials. However, lamination is a separate step and leads to a higher cost of production. In addition, the cut portions of the box will not be laminated with HCFC-resistant materials and, hence, are subject to the adverse effects of HCFC. Hence, to prevent the HCFC attack, an extra means of protection is necessary, adding to the complexity of the production process, furthermore, the use of dissimilar materials in boxes renders it difficult to recycle them.

It is also common practice to improve the mechanical properties of box making materials by incorporating fillers such as glass fibers (GF) and carbon fibers (CF). However, both GF and CF are bulky with a fiber diameter of 5–20 $\mu$m and a length of 100 $\mu$m to a few millimeters and will deteriorate considerably the surface smoothness and aesthetic appeal of the shaped parts. Furthermore, those fibers deteriorate the moldability of box making materials.

SUMMARY OF THE INVENTION

The present invention has been accomplished under these circumstances and has as an object providing heat insulating boxes that can be manufactured with the existing facilities and which will exhibit satisfactory strength, appearance and aesthetic appeal even if they are produced using a heat insulator urethane foam with either HCFC-123 or HCFC-141b or both being used as a foaming agent.

According to its first aspect, the present invention provides a heat insulating box that comprises a heat insulator urethane foam using either HCFC-123 or HCFC-141b or both as a foaming agent, and a box member that is in contact with said heat insulator and which is formed of a styrene/ethylene-α-olefinic rubbery copolymer/acrylonitrile terpolymer (AES resin) that contains 10–35 wt % of ethylene-α-olefinic rubbery copolymer and 25–50 wt % of acrylonitrile.

According to its second aspect, the present invention provides a heat insulating box that comprises a heat insulator urethane foam using either HCFC-123 or HCFC-141b or both as a foaming agent, and a box member that is in contact with said heat insulator and which is formed of a styrene/alkyl acrylate ester containing rubbery copolymer/acrylonitrile terpolymer (AAS resin) that contains 10–35 wt % of alkyl acrylate ester containing rubbery copolymer and 25–50 wt % of acrylonitrile.

According to its third aspect, the present invention provides a heat insulating box that comprises a heat insulator urethane foam using either HCFC-123 or HCFC-141b or both as a foaming agent, and a box member that is in contact with said heat insulator and which is formed of a resin composition in which a styrene/ethylene-α-olefinic rubbery copolymer/acrylonitrile terpolymer (AES resin) containing 10–35 wt % of ethylene-α-olefinic rubbery copolymer and 25–50 wt % of acrylonitrile is mixed with a styrene/alkyl acrylate ester containing rubbery copolymer/acrylonitrile terpolymer (AAS resin) containing 5–30 wt % of alkyl acrylate ester containing rubbery copolymer and 25–50 wt % of acrylonitrile in such proportions that said two rubbery copolymers are present in a total amount of 10–40 wt %.

According to its fourth aspect, the present invention provides a heat insulating box that comprises a heat insulator urethane foam using either HCFC-123 or HCFC-141b or both as a foaming agent, and a box member that is in contact with said heat insulator and which is formed of a styrene/acrylonitrile/butadiene terpolymer that contains at least 5 wt % of a styrene/acrylonitrile copolymer containing 5–50 wt % of an alkyl acrylate ester rubber.

DETAILED DESCRIPTION OF THE INVENTION

Figure 1:
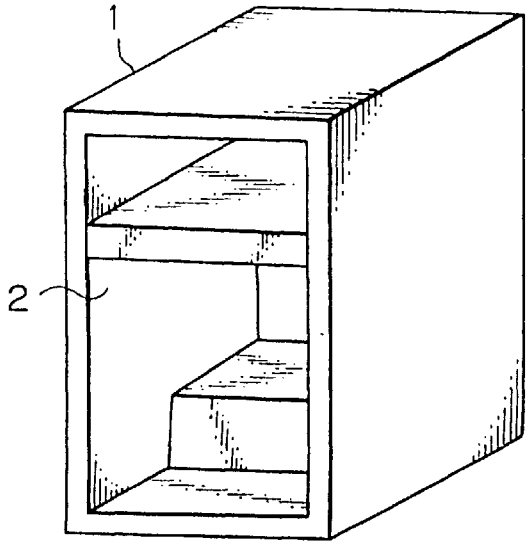
FIG. 1 is a perspective view of a typical refrigerator box.
Figure 2:
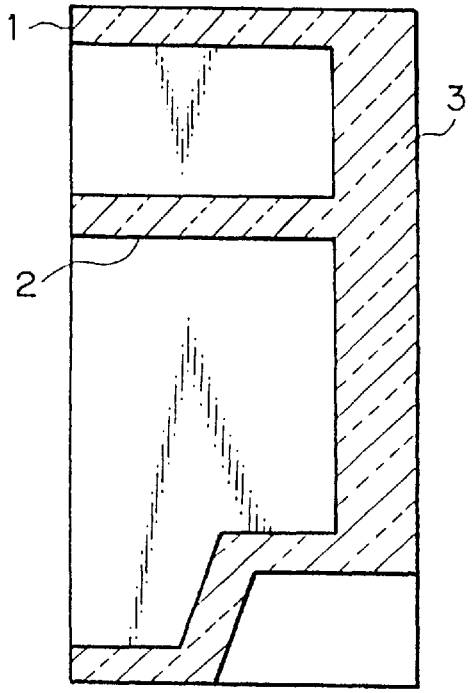
FIG. 2 is a cross section of FIG. 1.

Neither the ethylene-α-olefinic rubber copolymer contained in the AES resin according to the first aspect of the present invention nor the alkyl acrylate ester containing rubbery copolymer contained in the AAS resin according to the second aspect of the present invention dissolves in HCFC-123 or HCFC-141b and, hence, those copolymers will work advantageously in imparting high solvent resistance which is the major object of the present invention. The ethylene-α-olefinic rubbery copolymer or the alkyl acrylate ester containing rubbery copolymer must be contained in an amount of 10–35 wt %. Below 10 wt %, poor appearance such as a cracked surface will occur in an accelerated aging test on the heat insulating box that uses those copolymers. Above 35 wt %, both rigidity and mechanical properties will deteriorate and not only are the strength of the heat insulating box and the bruise resistance of its surface lowered but it also becomes difficult to assemble the box in a ready-to-use condition.

The ethylene-α-olefinic rubbery copolymer contained in the AES resin that is one component of the resin composition according to the third aspect of the present invention will not dissolve in HCFC-123 or HCFC-141b and, hence, it will work advantageously in imparting high solvent resistance. As a result, when the box of the present invention is to be used as a refrigerator box, it will exhibit high resistance to contamination by chemicals such as edible oils and seasonings. Further, the alkyl acrylate ester containing rubbery copolymer contained in the AAS resin which is the other component of the resin composition under consideration imparts the required low-temperature characteristic. Hence, the resin composition at issue can be provided with both high solvent resistance and the necessary low-temperature characteristic at the same time.

The ethylene-α-olefinic rubbery copolymer contained in the AES resin which is one component of the resin composition according to the third aspect of the present invention must be present in an amount of 10–35 wt %. Below 10 wt %, poor appearance such as a cracked surface will occur in an accelerated aging test on the heat insulating box that uses that resin composition. Above 35 wt %, both rigidity and mechanical strength will deteriorate and not only are the strength of the heat insulating box and the bruise resistance of its surface lowered but it also becomes difficult to assemble the box in a ready-to-use condition.

The alkyl acrylate ester containing rubbery copolymer contained in the AAS resin which is the other component of the resin composition according to the third aspect of the present invention must be present in an amount of 5–30 wt %. Below 5 wt %, poor appearance such as a cracked or blushed surface will occur in an accelerated aging test on the heat insulating box that uses that resin composition. Above 30 wt %, both rigidity and mechanical strength will deteriorate and not only are the strength of the heat insulating box and the bruise resistance of its surface lowered but it also becomes difficult to assemble the box in a ready-to-use condition.

The total sum of the contents of ethylene-α-olefinic rubbery copolymer and alkyl acrylate ester containing rubbery copolymer in the resin composition according to the third aspect of the present invention must lie in the range of 10–40 wt %. Below 10 wt %, poor appearance such as a cracked or blushed surface will occur in an accelerated aging test on the heat insulating box that uses that resin composition. Above 40 wt %, both rigidity and mechanical strength will deteriorate and not only are the strength of the heat insulating box and the bruise resistance of its surface lowered but it also becomes difficult to assemble the box in a ready-to-use condition.

If the styrene/acrylonitrile glassy copolymer in the AES resin, AAS resin or the resin composition consisting of a mixture of AES and AAS resins has an acrylonitrile content of less than 33 wt %, said glassy copolymer will dissolve (swell unlimitedly) in HCFC-123 and swell in HCFC-141b. However, as the acrylonitrile content exceeds 33 wt %, the copolymer becomes less soluble in those HCFC compounds and if it exceeds 40 wt %, the copolymer will absorb almost the same weight of HCFC-123 as its own weight and the amount of its swelling in HCFC-141b is negligibly small. Therefore, solvent resistance to certain kinds of Freon, which is the major object of the present invention, can be improved markedly by raising the acrylonitrile content of the glassy copolymer at issue to higher than 40 wt % but, on the other hand, the excessive presence of the acrylonitrile component will reduce considerably the heat stability of the AES resin, AAS resin or the resin composition consisting of the AES and AAS resins in admixture.

Thus, the styrene-acrylonitrile glassy copolymer according to the present invention is not invariable in solvent resistance. The present inventors formed sheets from the AES resin, AAS resin or the resin composition consisting of the AES and AAS resins in admixture which are recited in claims, and subjected the sheets to heat cycle tests, in which the sheets were held alternately under hot and cold conditions as they were placed in contact with a heat insulator urethane foam using either HCFC-123 or HCFC-141b or both as a foaming agent. As a result, it was found that no deterioration such as cracking occurred in the sheets placed in contact with the heat insulator urethane foam.

The AES resin, AAS resin, as well as the resin composition consisting of a mixture of the AES and AAS resins according to the present invention are characterized by various features such as good processability, high susceptibility to pigmentation, high impact strength and cold resistance; hence, by using those resins or resin composition, heat insulating boxes can be manufactured that will not experience resin deterioration and that exhibit high moldability and processability together with appearance of good aesthetic appeal even if they are used in those applications where they are held in contact with a heat insulator urethane foam using either HCFC-123 or HCFC-141b or both as a foaming agent.

The styrene-acrylonitrile resin containing an alkyl acrylate ester rubber as used in accordance with the fourth aspect of the present invention is a known material and will swell upon absorbing HCFC-123 or HCFC-141b. The solvent resistance of the styrene-acrylonitrile/butadiene terpolymer (ABS resin) as used in the fourth aspect of the present invention will vary greatly with the percentage of copolymerization of the acrylonitrile component. If the content of acrylonitrile is less than 40 parts by weight for 100 parts by weight of styrene, the terpolymer at issue will dissolve (swell unlimitedly) in HCFC-123 and swell in HCFC-141b. Thus, the alkyl acrylate ester rubber containing styrene/acrylonitrile resin or the ABS resin, according to the fourth aspect of the present invention does not necessarily have high solvent resistance to HCFC-123 or HCFC-141b if they are used individually. In fact, the present inventors blended the two resins in proportions such that the acrylonitrile/alkyl acrylate ester rubbery polymer/styrene resin includes 5–50 wt % alkyl acrylate ester rubbery polymer, and the resin composition includes at least 5 wt % acrylonitrile/alkyl acrylate ester rubbery polymer/styrene resin, and using the blend, they formed a box that would be placed in contact with a heat insulator urethane foam using either HCFC-123 or HCFC-141b or both as a foaming agent. The inventors then subjected the box to a heat cycle test, in which the box was held alternately under hot and cold conditions; the result was, no cracks developed in the box which was held in contact with the heat insulator urethane foam. Furthermore, the styrene-acrylonitrile resin containing an alkyl acrylate ester rubber is similar to the ABS resin in the temperature range for the shaping of sheets by either extrusion or vacuum forming and it will exhibit consistent tensile strength and elongation characteristics in tensile behavior over a broad temperature range above 100° C.; hence, the alkyl acrylate ester rubber containing styrene/acrylonitrile resin can be blended with the ABS resin without damaging its good vacuum formability, thereby making it possible to form the intended box by molding. In addition, the styrene/acrylonitrile resin under consideration has a milky white color and, hence, can be blended with the ABS resin without impairing its high susceptibility to pigmentation; hence, the resin at issue can be colored to give a comparable result to the ABS resin. As a further advantage, the resin at issue has good lightfastness, high weathering in the natural environment and high resistance to thermal and oxidative deterioration and, hence, the ABS resin having incorporated therein the styrene/acrylonitrile resin containing an alkyl acrylate ester rubber will exhibit excellent stability for a long time. Thus, the intended object of the present invention according to its fourth aspect can be attained by forming a box of the ABS resin containing at least 5 wt % of the styrene/acrylonitrile resin which contains 5–50 wt % of the alkyl acrylate ester rubber component.

The ethylene-α-olefinic rubbery copolymer in the styrene/ethylene-α-olefinic rubbery copolymer/acrylonitrile terpolymer (AES resin) according to the first aspect of the present invention may be exemplified by an ethylene-propylene or ethylene-butene copolymer (EPR) and an ethylene-propylene or nonconjugated diene copolymer (EPDM). These rubber components are dispersed in particulate form in the styrene-acrylonitrile glassy copolymer or part of the latter is bonded chemically to the dispersed rubber particles.

The alkyl acrylate ester containing rubbery copolymer in the styrene/alkyl acrylate ester containing rubbery copolymer/acrylonitrile terpolymer (AAS resin) according to the second aspect of the present invention is a rubbery copolymer prepared by copolymerizing at least one monomeric acrylic acid ester having $C_{1-16}$ alkyl groups with a copolymerizable monomer such as a crosslinking agent or a grafting agent. Examples of the monomeric acrylic acid ester having $C_{1-16}$ alkyl groups include methyl acrylate, ethyl acrylate, butyl acrylate and 2-ethylhexyl acrylate. These rubber components are dispersed in particulate form in the styrene-acrylonitrile glassy copolymer or part of the latter is bonded chemically to the dispersed rubber particles.

Both the content of the ethylene-α-olefinic rubbery copolymer in the AES resin according to the first aspect of the present invention and the content of the alkyl acrylate ester containing rubbery copolymer in the AAS resin according to the second aspect of the present invention must lie within the range of 10–35 wt %. If the contents are outside this range, the disadvantages already described above will occur.

The AES and AAS resins are mixed to form the resin composition according to the third aspect of the present invention. The content of the ethylene-α-olefinic rubber copolymer in the AES resin must lie within the range of 10–35 wt %, and the content of the alkyl acrylate ester containing rubbery copolymer in the AAS resin must lie within the range of 5–30 wt %. The total sum of the contents of the ethylene-α-olefinic rubbery copolymer and the alkyl acrylate ester containing rubbery copolymer must lie within the range of 10–40 wt %. If the respective contents are outside the specified ranges, the disadvantages already described above will occur.

In accordance with the first, second and third aspects of the present invention, the styrene/acrylonitrile glassy copolymer is used in order to provide improved solvent resistance to Freons such as HCFC-123 and HCFC-141b, which is the major object of the present invention. The acrylonitrile content of the styrene/acrylonitrile glassy copolymer must be 25–50 wt % of the AES or AAS resin. Below 25 wt %, the resins or resin composition at issue do not have satisfactory resistance to the Freons mentioned above and, hence, if they are used to make heat insulating boxes, poor appearance such as a cracked or blushed surface will occur. Above 50 wt %, the resins or resin composition will deteriorate in the process of shaping and otherwise processing them into the heat insulating box of the present invention, thus causing a higher melt viscosity or considerable discoloration.

The styrene/acrylonitrile/butadiene terpolymer (ABS resin) to be used in accordance with the fourth aspect of the present invention is such that the rubber component is composed of at least one member selected from among butadiene, a styrene-butadiene copolymer and an acrylonitrile-butadiene copolymer. These rubber components are dispersed in particulate form in a glassy polymer or part of the latter may be bonded chemically to the dispersed rubber particles. The glassy polymer is a continuous phase that is produced by polymerizing at least one monomer selected from among styrene, p-methylstyrene, α-methylstyrene, acrylonitrile, alkyl acrylate based vinyl monomers, acrylic acid based vinyl monomers, N-phenylmaleimide, etc.

The styrene/acrylonitrile resin containing an alkyl acrylate ester rubber component according to the fourth aspect of the present invention is such that the rubber component is produced by polymerizing at least one member selected from among methyl acrylate, ethyl acrylate, n-propyl acrylate, n-butyl acrylate, isobutyl acrylate, n-pentyl acrylate, isoamyl acrylate, n-hexyl acrylate, 2-methylphentyl acrylate, 2-ethylhexyl acrylate, n-octyl acrylate, etc., with a crosslinking agent being used as selected from among vinyl compounds having two or more unsaturated bonds in the molecule, such as divinylbenzene, alkylidene norbornane, alkenyl norbornane, dicyclopentadiene, methyl cyclopentadiene, butadiene and isoprene. These rubber components are dispersed in particulate form in a glassy polymer or part of the latter may be bonded chemically to the dispersed rubber particles. The glassy polymer is a continuous phase that is produced by polymerizing at least one monomer selected from among styrene, p-methylstyrene, α-methylstyrene, acrylonitrile, alkyl acrylate based vinyl monomers, acrylic acid based vinyl monomers, N-phenylmaleimide, etc. Thus, useful as the styrene/acrylonitrile resin containing the alkyl acrylate ester rubber component according to the fourth aspect of the present invention are Weatherfil (trade name of Ube Cycon, Ltd.), GELOY (trade name of General Electric Company), and Diarak A (trade name of Mitsubishi Rayon Co., Ltd.), which are commonly referred to as ASA or AAS resins. The content of the alkyl acrylate ester rubber in the styrene/acrylonitrile resin under consideration is within the range of 5–50 wt %, desirably in the range of 15–50 wt %. Below 5 wt %, the intended effect of incorporating the alkyl acrylate ester rubber is not attained and a phenomenon of destruction such as cracking will occur in the inner box if a heat insulator urethane foam is used in the present of HCFC as a foaming agent. Above 50 wt %, great anisotropy will develop in the impact resistance of the ABS resin incorporated, and various defects will occur such as a lower impact resistance of the shaped part, increasing difficulty in handling the heat insulating box for assembling it in a ready-to-use condition, and a lower strength of the assembled box. The styrene/acrylonitrile copolymer containing 5–50 wt % of the alkyl acrylate ester rubber component must be contained in an amount of at least 5 wt %, preferably 5–50 wt %. Below 5 wt %, the intended effect of using the styrene/acrylonitrile copolymer at issue is not attained.

The following examples are provided for the purpose of further illustrating the present invention but are in no way to be taken as limiting.

EXAMPLE 1

Four samples of a styrene/ethylene-α-olefinic rubbery copolymer/acrylonitrile terpolymer were prepared, with the acrylonitrile content being adjusted as shown in Table 1 below.

TABLE 1

| Acrylonitrile content of AES resin (wt %) | 25 | 30 | 40 | 50 |
|---|---|---|---|---|
| Extrusion moldability | ○ | ○ | ○ | Δ |
| Appearance of extruded sheet | ○ | ○ | ○ | Δ |
| Resistance to heat cycles (HCFC-123) | Δ | Δ | Δ | ○ |
| Resistance to heat cycles (HCFC-141b) | ○ | ○ | ○ | ○ |
| Strength of inner box | ○ | ○ | ○ | ○ |

○: good;
Δ: acceptable

After adding a stabilizer, a lubricant and any other additives, the ingredients were melt blended into pellets on a kneader/extruder in accordance with the usual method. Each lot of the pellets was shaped into a sheet through a sheet extruder equipped with a coat hanger die. and the sheets were vacuum formed to shape inner boxes of a refrigerator as a heat insulating box. Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests, giving the results also shown in Table 1. In the heat cycle tests, 10 cycles each consisting of cooling at −20° C. for 12 h and heating at 50° C. for 12 h were performed and the state of each box under test was visually examined.

EXAMPLE 2

Inner boxes for refrigerator were shaped by repeating the procedure of Example 1 except that the content of the rubbery copolymer in the styrene/ethylene-α-olefinic rubbery copolymer/acrylonitrile terpolymers was adjusted as shown in Table 2 below.

TABLE 2

| Rubbery copolymer content of AES resin (wt %) | 10 | 25 | 30 | 35 |
|---|---|---|---|---|
| Extrusion moldabillty | ○ | ○ | Δ | Δ |
| Appearance of extruded sheet | ○ | ○ | ○ | ○ |
| Resistance to heat cycles (HCFC-123) | Δ | Δ | Δ | ○ |
| Resistance to heat cycles (HCFC-141b) | Δ | ○ | ○ | ○ |
| Strength of inner box | ○ | ○ | Δ | Δ |

○: good;
Δ: acceptable

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle test as in Example 1 and the results are also shown in Table 2.

COMPARATIVE EXAMPLE 1

Inner boxes for refrigerator were shaped by repeating the procedure of Example 1 except that the content of the rubbery copolymer in the styrene/ethylene-α-olefinic rubbery copolymer/acrylonitrile terpolymers was adjusted as shown in Table 3 below.

TABLE 3

| Rubbery copolymer content of AES resin (wt %) | 5 | 40 | 50 |
|---|---|---|---|
| Extrusion moldability | ○ | Δ | x |
| Appearance of extruded sheet | ○ | ○ | ○ |
| Resistance to heat cycles (HCFC-123) | C | ○ | ○ |
| Resistance to heat cycles (HCFC-141b) | C | ○ | ○ |
| Strength of inner box | ○ | x | x |

○: good;
Δ: acceptable;
x: unacceptable;
C: cracks developed

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 3. Obviously, when the content of the rubbery copolymer in the AES resin was lower than 10 wt %, cracks developed in the heat cycle tests whereas when the content of that component was more than 35 wt %, the viscosity of the AES resin increased so much that troubles occurred in the process of sheet extrusion and, at the same time, the AES resin became too soft to maintain the strength required for the heat insulating box.

COMPARATIVE EXAMPLE 2

Inner boxes for refrigerator were shaped by repeating the procedure of Example 1 except that the content of acrylonitrile in the styrene/ethylene-α-olefinic rubber copolymer/acrylonitrile terpolymers was adjusted as shown in Table 4 below.

TABLE 4

| Acrylonitrile content of AES resin (wt %) | 8 | 15 | 20 | 55 | 60 |
|---|---|---|---|---|---|
| Extrusion moldability | ○ | ○ | ○ | x | x |
| Appearance of extruded sheet | ○ | ○ | ○ | Y | Y |
| Resistance to heat cycles (HCFC-123) | C | C | C | ○ | ○ |
| Resistance to heat cycles (HCFC-141b) | B | C | C | ○ | ○ |
| Strength of inner box | ○ | ○ | ○ | ○ | ○ |

○: good;
C: cracks developed;
Y: color changed to reddish yellow;
B: blushing
x: unacceptable because of excessive increase in viscosity due to resin detention Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 4. Obviously, when the acrylonitrile content of the AES resin was less than 25 wt %, cracking or blushing occurred in the heat cycle tests whereas when the acrylonitrile content was higher than 50 wt %, the viscosity of the AES resin increased so much that troubles occurred in the process of sheet extrusion. Furthermore, the color of the extruded sheets changed to reddish yellow, impairing considerably the aesthetic appeal of the appearance of the heat insulating boxes which were made of those sheets.

EXAMPLE 3

Inner boxes for refrigerator were shaped by repeating the procedure of Example 1 except that the acrylonitrile content of styrene/alkyl acrylate ester containing rubbery copolymer/acrylonitrile terpolymers (AAS resin) was adjusted as shown in Table 5 below.

TABLE 5

| Acrylonitrile content of AAS resin (wt %) | 25 | 30 | 40 | 50 |
|---|---|---|---|---|
| Extrusion moldability | ○ | ○ | ○ | Δ |
| Appearance of extruded sheet | ○ | ○ | ○ | Δ |
| Resistance to heat cycles (HCFC-123) | Δ | Δ | Δ | ○ |
| Resistance to heat cycles (HCFC-141b) | ○ | ○ | ○ | ○ |
| Strength of inner box | ○ | ○ | ○ | ○ |

○: good;
Δ: acceptable

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 5.

EXAMPLE 4

Inner boxes for refrigerator were shaped by repeating the procedure of Example 1 except that the rubbery copolymer content of styrene/alkyl acrylate ester containing rubbery copolymer/acrylonitrile terpolymers (AAS resin) was adjusted as shown in Table 6 below.

TABLE 6

| Rubbery copolymer content of AAS resin (wt %) | 10 | 25 | 30 | 35 |
|---|---|---|---|---|
| Extrusion moldability | ○ | ○ | Δ | Δ |
| Appearance of extruded sheet | ○ | ○ | ○ | ○ |
| Resistance to heat cycles (HCFC-123) | Δ | Δ | Δ | ○ |
| Resistance to heat cycles (HCFC-141b) | Δ | ○ | ○ | ○ |
| Strength of inner box | ○ | ○ | Δ | Δ |

○: good;
Δ: acceptable

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 6.

COMPARATIVE EXAMPLE 3

Inner boxes for refrigerator were shaped by repeating the procedure of Example 1 except that the rubbery copolymer content of the styrene/alkyl acrylate ester containing rubbery copolymer/acrylonitrile terpolymers (AAS resin) was adjusted as shown in Table 7 below.

TABLE 7

| Rubbery copolymer content of AAS resin (wt %) | 5 | 40 | 50 |
|---|---|---|---|
| Extrusion moldability | ○ | Δ | x |
| Appearance of extruded sheet | ○ | ○ | ○ |
| Resistance to heat cycles (HCFC-123) | C | ○ | ○ |
| Resistance to heat cycles (HCFC-141b) | C | ○ | ○ |
| Strength of Inner box | ○ | x | x |

○: good;
Δ: acceptable;
x; unacceptable;
C: cracks developed

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 7. Obviously, when the content of the rubbery copolymer in the AAS resin was lower than 10 wt %, cracks developed in the heat cycle tests whereas when the content of that component was higher than 35 wt %, the viscosity of the AAS resin increased so much that troubles occurred in the process of sheet extrusion and, at the same time, the AAS resin became too soft to maintain the strength required for the heat insulating box.

COMPARATIVE EXAMPLE 4

Inner boxes for refrigerator were shaped by repeating the procedure of Example 1 except that the content of acrylonitrile in the styrene/alkyl acrylate ester containing rubbery copolymer/acrylonitrile terpolymers (AAS resin) was adjusted as shown in Table 8 below.

TABLE 8

| Acrylonitrile content of AAS resin (wt %) | 8 | 15 | 20 | 55 | 60 |
|---|---|---|---|---|---|
| Extrusion moldability | ○ | ○ | ○ | x | x |
| Appearance of extruded sheet | ○ | ○ | ○ | Y | Y |
| Resistance to heat cycles (HCFC-123) | C | C | C | ○ | ○ |
| Resistance to heat cycles (HCFC-141b) | B | C | C | ○ | ○ |
| Strength of inner box | ○ | ○ | ○ | ○ | ○ |

○: good;
C: cracks developed;
Y: color changed to reddish yellow;
B: blushing
x: unacceptable because of excessive increase in viscosity due to resin detention Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 8. Obviously, when the acrylonitrile content of the AAS resin was less than 25 wt %, cracking or blushing occurred in the heat cycle tests whereas when the acrylonitrile content was higher than 50 wt %, the viscosity of the AAS resin increased so much that troubles occurred in the process of sheet extrusion. Furthermore, the color of the extruded sheets changed to reddish yellow, impairing considerably the aesthetic appeal of the appearance of the heat insulating boxes which were made of those sheets.

EXAMPLE 5

Inner boxes for refrigerator were shaped by repeating the procedure of Example 1 except that the content of acrylonitrile in resin compositions consisting of AES and AAS resins in admixture was adjusted as shown in Table 9 below.

TABLE 9

| Acrylonitrile content of resin composition (wt %) | 25 | 30 | 40 | 50 |
|---|---|---|---|---|
| Extrusion moldability | ○ | ○ | ○ | Δ |
| Appearance of extruded sheet | ○ | ○ | ○ | Δ |
| Resistance to heat cycles (HCFC-123) | Δ | Δ | ○ | ○ |
| Resistance to heat cycles (HCFC-141b) | ○ | ○ | ○ | ○ |
| Strength of inner box | ○ | ○ | ○ | ○ |

○: good;
Δ: acceptable

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 9.

EXAMPLE 6

Inner boxes for refrigerator were shaped by repeating the procedure of Example 1 except that the content of rubbery copolymer in resin compositions consisting of AES and AAS resins in admixture was adjusted as shown in Table 10 below.

TABLE 10

| Rubbery copolymer content of resin composition (wt %) | 10 | 20 | 30 | 35 | 40 |
|---|---|---|---|---|---|
| Extrusion moldability | ○ | ○ | ○ | Δ | Δ |
| Appearance of extruded sheet | ○ | ○ | ○ | ○ | Δ |
| Resistance to heat cycles (HCFC-123) | Δ | Δ | ○ | ○ | ○ |
| Resistance to heat cycles (HCFC-141b) | Δ | ○ | ○ | ○ | ○ |
| Strength of inner box | ○ | ○ | ○ | ○ | ○ |

○: good;
Δ: acceptable

Each of the inner boxes was Joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 10.

COMPARATIVE EXAMPLE 5

Inner boxes for refrigerator were shaped by repeating the procedure of Example 1 except that the content of acrylonitrile in resin compositions consisting of AES and AAS resins in admixture was adjusted as shown in Table 11 below.

TABLE 11

| Acrylonitrile content of resin composition (wt %) | 8 | 15 | 20 | 55 | 60 |
|---|---|---|---|---|---|
| Extrusion moldability | ○ | ○ | ○ | x | x |
| Appearance of extruded sheet | ○ | ○ | ○ | Y | Y |
| Resistance to heat cycles (HCFC-123) | C | C | C | ○ | ○ |
| Resistance to heat cycles (HCFC-141b) | B | C | Δ | ○ | ○ |
| Strength of inner box | Δ | ○ | ○ | ○ | ○ |

○: good;
Δ: acceptable;
C: cracks developed
Y: color changed to reddish yellow;
B: blushing
x: unacceptable because of excessive increase in viscosity due to resin detention Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 11. Obviously, when the acrylonitrile content of the resin composition consisting of a mixture of AES and AAS resins was less than 25 wt %, cracking or blushing occurred in the heat cycle tests whereas when the acrylonitrile content was higher than 50 wt %, the viscosity of the resin composition increased so much that troubles occurred in the process of sheet extrusion. Furthermore, the color of the extruded sheets changed to reddish yellow, impairing considerably the aesthetic appeal of the appearance of the heat insulating boxes which were made of those sheets.

COMPARATIVE EXAMPLE 6

Inner boxes for refrigerator were shaped by repeating the procedure of Example 1 except that the content of rubbery copolymer in resin compositions consisting of AES and AAS resins in admixture was adjusted as shown in Table 12 below.

TABLE 12

| Rubbery copolymer content of resin composition (wt %) | 5 | 45 | 55 |
|---|---|---|---|
| Extrusion moldability | Δ | Δ | x |
| Appearance of extruded sheet | ○ | ○ | Δ |
| Resistance to heat cycles (HCFC-123) | x | ○ | Δ |
| Resistance to heat cycles (HCFC-141b) | B | ○ | ○ |
| Strength of inner box | ○ | x | x |

○: good;
Δ: acceptable;
x: unacceptable;
B: blushing

Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 12. Obviously, when the rubbery copolymer content of the resin composition consisting of AES and AAS resins in admixture was less than 10 wt %, cracking and blushing occurred in the heat cycle tests whereas when the content of that component was higher than 40 wt %, the viscosity of the resin composition increased so much that troubles occurred in the process of sheet extrusion and, at the same time, the resin composition became too soft to maintain the strength required for the insulating box.

COMPARATIVE EXAMPLE 7

Inner boxes for refrigerator were shaped by repeating the procedure of Example 1 except that the AES resin or AAS resin was replaced by an ABS resin, in which a butadiene rubber was substituted for the ethylene-α-olefinic rubbery copolymer serving as the rubber component of the AES resin, or for the alkyl acrylate ester containing rubbery copolymer also serving as the rubber component of the AAS resin. Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests as in Example 1 and the results are also shown in Table 13 below.

TABLE 13

| Rubber component | Butadiene |
|---|---|
| Extrusion moldability | ○ |
| Appearance of extruded sheet | ○ |
| Resistance to heat cycles (HCFC-123) | C |
| Resistance to heat cycles (HCFC-141b) | C |
| Strength of inner box | ○ |

○: good; C: cracks developed

As one can see from Table 13, cracks developed in the inner box and, hence, the ABS resin containing butadiene as a rubber component was unsuitable for use as a material for making the inner box for refrigerator.

As described on the foregoing pages, there is provided according to the first aspect of the present invention a heat insulating box that comprises a heat insulator urethane foam using either HCFC-123 or HCFC-141b or both as a foaming agent, and a box member that is in contact with said heat insulator and which is formed of a styrene/ethylene-α-olefinic rubbery copolymer/acrylonitrile terpolymer (AES resin) that contains 10–35 wt % of ethylene-α-olefinic rubbery copolymer and 20–50 wt % of acrylonitrile. According to the second aspect of the present invention, there is provided a heat insulating box that comprises a heat insulator urethane foam using either HCFC-123 or HCFC-141b or both as a foaming agent, and a box member that is in contact with said heat insulator and which is formed of a styrene/alkyl acrylate ester containing rubbery copolymer/acrylonitrile terpolymer (AAS resin) that containing 10–35 wt % of alkyl acrylate ester containing rubbery copolymer and 25–50 wt % of acrylonitrile. According to its third aspect, the present invention provides a heat insulating box that comprises a heat insulator urethane foam using either HCFC-123 or HCFC-141b or both as a foaming agent, and a box member that is in contact with said heat insulator and which is formed of a resin composition in which a styrene/ ethylene-α-olefinic rubbery copolymer/acrylonitrile terpolymer (AES resin) containing 10–35 wt % of ethylene-α-olefinic rubbery copolymer and 25–50 wt % of acrylonitrile is mixed with a styrene/alkyl acrylate ester containing rubbery copolymer/acrylonitrile terpolymer (AAS resin) containing 5–30 wt % of alkyl acrylate ester containing rubbery copolymer and 25–50 wt % of acrylonitrile in such proportions that said two rubbery copolymers are present in a total amount of 10–40 wt %. In either of the three aspects described above, the present invention provides heat insulating boxes that can be manufactured with the existing facilities and which will exhibit satisfactory strength, appearance and aesthetic appeal even if they are produced using a urethane foam with either HCFC-123 or HCFC-141b or both being used as a foaming agent.

EXAMPLE 7

EX 200 (trade name of Ube Cycon, Ltd.) was used as an ABS resin, and GELOY-GY1120 (trade name of General Electric Company) was used as a styrene-acrylonitrile resin containing an alkyl acrylate ester rubber. The pellets of the ABS resin were mixed with the pellets of GELOY-GY1120 in the various proportions shown in Table 14. The ingredients were then melt blended into pellets on a kneader/extruder in accordance with the usual method. Each lot of the pellets was shaped into a sheet through a sheet extruder equipped with a coat hanger die, and the sheets were vacuum formed to shape inner boxes of a refrigerator as a heat insulating box. Each of the inner boxes was joined integrally with the outer box by means of a liquid urethane stock that was blown with HCFC-123 or HCFC-141b being used as a foaming agent, whereby a refrigerator box was assembled as shown in FIG. 1. The refrigerator boxes thus constructed were subjected to heat cycle tests, giving the results also shown in Table 14. In the heat cycle tests, 10 cycles each consisting of cooling at −20° C. for 12 h and heating at 50° C. for 12 h were performed and the state of each box under test was visually examined.

TABLE 14

| GELOY-GY1120 (wt %) | 5 | 10 | 20 | 30 | 40 |
|---|---|---|---|---|---|
| Extrusion moldability | ○ | ○ | ○ | ○ | ○ |
| Appearance of extruded sheet | ○ | ○ | ○ | ○ | Δ |
| Resistance to heat cycles (HCFC-123) | Δ | Δ | ○ | ○ | ○ |
| Resistance to heat cycles (HCFC-141b) | Δ | ○ | ○ | ○ | ○ |
| Strength of inner box | ○ | ○ | ○ | ○ | Δ |

○: good; Δ: acceptable

EXAMPLE 8

EX 200 (trade name of Ube Cycon, Ltd.) was used as an ABS resin, and GELOY-XP1001 (trade name of General Electric Company) was used as a styrene-acrylonitrile resin containing an alkyl acrylate ester rubber. The pellets of the ABS resin were mixed with GELOY-XP1001 in the various proportions shown in Table 15. The ingredients were then melt blended into pellets on a kneader/extruder in accordance with the usual method. Using the pellets, inner boxes for refrigerator were made by the same procedure as in Example 7. Each of the inner boxes was joined integrally with the outer box as in Example 7 and the completed refrigerator boxes were tested for their performance. The results are also shown in Table 15.

TABLE 15

| GELOY-XP1001 (wt %) | 5 | 10 | 20 | 30 | 40 |
|---|---|---|---|---|---|
| Extrusion moldability | ○ | ○ | ○ | ○ | Δ |
| Appearance of extruded sheet | ○ | ○ | ○ | ○ | ○ |
| Resistance to heat cycles (HCFC-123) | Δ | Δ | Δ | ○ | ○ |
| Resistance to heat cycles (HCFC-141b) | Δ | Δ | ○ | ○ | ○ |
| Strength of inner box | ○ | ○ | ○ | ○ | Δ |

○: good; Δ: acceptable

EXAMPLE 9

EX200 (trade name of Ube Cycon, Ltd.) was used as an ABS resin, and Weatherfil MD120 (trade name of Ube Cycon, Ltd.) was used as a styrene-acrylonitrile resin containing an alkyl acrylate ester rubber. The pellets of the ABS resin were mixed with Weatherfil MD120 in the various proportions shown in Table 16. The ingredients were then melt blended into pellets on a kneader/extruder in accordance with the usual method. Using the pellets, inner boxes for refrigerator were made by the same procedure as in Example 7. Each of the inner boxes was joined integrally with the outer box as in Example 7 and the completed refrigerator boxes were tested for their performance. The results are also shown in Table 16.

TABLE 16

| Weatherfil MD120 (wt %) | 5 | 10 | 20 | 30 | 40 |
|---|---|---|---|---|---|
| Extrusion moldability | ○ | ○ | ○ | ○ | Δ |
| Appearance of extruded sheet | ○ | ○ | ○ | ○ | ○ |
| Resistance to heat cycles (HCFC-123) | Δ | Δ | Δ | ○ | ○ |
| Resistance to heat cycles (HCFC-141b) | Δ | Δ | ○ | ○ | ○ |
| Strength of inner box | ○ | ○ | ○ | ○ | Δ |

○: good; Δ: acceptable

EXAMPLE 10

EX200 (trade name of Ube Cycon, Ltd.) was used as an ABS resin, and Diarak A-S710 (trade name of Mitsubishi Rayon Co., Ltd.) was used as a styrene-acrylonitrile resin containing an alkyl acrylate ester rubber. The pellets of the ABS resin were mixed with Diarak A-S710 in the various proportions shown in Table 17. The ingredients were then melt blended into pellets on a kneader/extruder in accordance with the usual method. Using the pellets, inner boxes were joined integrally with the outer box as in Example 7 and the completed refrigerator boxes were tested for their performance. The results are also shown in Table 17.

TABLE 17

| Diarak A-S710 (wt %) | 5 | 10 | 20 | 30 | 40 |
|---|---|---|---|---|---|
| Extrusion moldability | ○ | ○ | ○ | ○ | Δ |
| Appearance of extruded sheet | ○ | ○ | ○ | ○ | ○ |
| Resistance to heat cycles (HCFC-123) | Δ | Δ | ○ | ○ | ○ |
| Resistance to heat cycles (HCFC-141b) | Δ | Δ | ○ | ○ | ○ |
| Strength of inner box | ○ | ○ | ○ | ○ | Δ |

○: good; Δ: acceptable

COMPARATIVE EXAMPLE 8

For comparison, inner boxes were made using the following five ABS resins which were conventionally used in extrusion molding and which were all available from Ube Cycon, Ltd.; they were GSW, GSE, EX200, EX201 and EX245. Each of the inner boxes was joined integrally with the outer box as in Example 7 and the completed refrigerator boxes were tested for their performance. The results are also shown in Table 18, from which one can see that cracks developed in all the inner boxes subjected to the heat cycle tests using HCFC-123 or HCFC-141b as a foaming agent. It was therefore clear that the five ABS resins tested were unsuitable for use as materials for making the inner box for refrigerator.

TABLE 18

| ABS resin | GSW | GSE | EX200 | EX201 | EX245 |
|---|---|---|---|---|---|
| Extrusion moldability | ○ | ○ | ○ | ○ | ○ |
| Appearance of extruded sheet | ○ | ○ | ○ | ○ | ○ |
| Resistance to heat cycles (HCFC-123) | C | C | C | C | C |
| Resistance to heat cycles (HCFC-141b) | C | C | C B | C B | ○ |
| Strength of inner box | ○ | ○ | ○ | ○ | ○ |

○: good; Δ: acceptable;
C: cracks developed; B: blushing

As one can see from the foregoing description, the heat insulating box according to the fourth aspect of the present invention is suitable for use in practical applications and could attain the intended object when it was put to actual use.

Examples 7–10 concern a refrigerator box as a specific example of the heat insulating box according to the fourth aspect of the present invention. It should, however, be noted that this is not the sole case of the present invention and that equally good results can be achieved even if the present invention is applied to containers for keeping things at relatively high temperatures. Needless to say, results that are comparable to those of Examples 7–10 can be achieved even when such containers are used in contact with a heat insulator urethane foam that uses either HCFC-123 or HCFC-141b as a foaming agent.

Further, in Examples 7–10, the resin composition according to the fourth aspect of the present invention was used only in the inner box of the heat insulating box: it should, however, be noted that equally good results can be attained even if said resin composition is used in the outer box of the heat insulating box.

In summary, according to the fourth aspect of the present invention, there is provided a heat insulating box that comprises a heat insulator urethane foam using either HCFC-123 or HCFC-141b or both as a foaming agent, and a box member that is in contact with said heat insulator and which is formed of a styrene/acrylonitrile/butadiene terpolymer that contains at least 5 wt % of a styrene/acrylonitrile copolymer containing 5–50 wt % of an alkyl acrylate ester rubber. This heat insulating box can be manufactured with the existing facilities and it will exhibit satisfactory strength, appearance and aesthetic appeal even if it is produced using a heat insulator urethane foam with either HCFC-123 or HCFC-141b or both being used as a foaming agent.

What is claimed is:

1. A heat insulating box comprising:

a heat insulator comprising a urethane foam; and a box member that is in contact with said heat insulator, characterized in that either $CHCl_2CF_3$ or $CH_3CCl_2F$ or both are used as a foaming agent of the urethane foam, and the box member is formed of an acrylonitrile/alkyl acrylate ester rubbery polymer/styrene resin (ASA resin), wherein said acrylonitrile/alkyl acrylate ester rubbery copolymer/styrene resin comprises an alkyl acrylate ester rubbery polymer phase and an acrylonitrile-styrene copolymer phase, said acrylonitrile/alkyl acrylate ester rubbery polymer/styrene resin includes 10–35 wt % alkyl acrylate ester rubbery polymer, and said acrylonitrile-styrene copolymer phase includes 25–44 wt % acrylonitrile.

2. The heat insulating box as recited in claim 1, wherein said alkyl acrylate ester rubbery polymer comprises a rubbery polymer prepared by polymerizing at least one monomeric acrylic acid ester having $C_{1-16}$ alkyl groups with a polymerizable monomer selected from the group consisting of a crosslinking agent and a grafting agent.

3. The heat insulating box as recited in claim 2, wherein said monomeric acrylic acid ester is selected from the group consisting of methyl acrylate, ethyl acrylate, butyl acrylate, and 2-ethylhexyl acrylate.

4. A heat insulating box comprising:

a heat insulator comprising a urethane foam; and a box member that is in contact with said heat insulator, characterized in that either $CHCl_2CF_3$ or $CH_3CCl_2F$ or both are used as a foaming agent of the urethane foam, and the box member is formed of a resin composition comprising an acrylonitrile/alkyl acrylate ester rubbery polymer/styrene resin (ASA resin) and an acrylonitrile/butadiene/styrene resin (ABS resin) comprising a rubber component and a glassy polymer, wherein said acrylonitrile/alkyl acrylate ester rubbery polymer/styrene resin includes 5–50 wt % alkyl acrylate ester rubbery polymer, and said resin composition includes at least 5 wt % acrylonitrile/alkyl acrylate ester rubbery polymer/styrene resin.

5. The heat insulating box as recited in claim 4, wherein said rubber component comprises at least one member selected from the group consisting of butadiene, a styrene/butadiene copolymer, and an acrylonitrile-butadiene copolymer.

6. The heat insulating box as recited in claim 4, wherein said glassy polymer comprises the polymerization product of at least one member selected from the group consisting of styrene, p-methylstyrene, α-methylstyrene, acrylonitrile, alkyl acrylate based vinyl monomers, acrylic acid based vinyl monomers, and N-phenylmaleimide.

7. The heat insulating box as recited in claim 4, wherein said alkyl acrylate ester rubbery polymer comprises the polymerization product of at least one member selected from the group consisting of methyl acrylate, ethyl acrylate, n-propyl acrylate, n-butyl acrylate, isobutyl acrylate, n-pentyl acrylate, isoamyl- acrylate, n-hexyl acrylate, 2-methylpentyl acrylate, 2-ethylhexyl acrylate, and n-octyl acrylate.

8. A heat insulating box comprising:

a heat insulator comprising a urethane foam; and a box member that is in contact with said heat insulator, characterized in that either $CHCl_2CF_3$ or $CH_3CCl_2F$ or both are used as a foaming agent of the urethane foam, and the box member consists essentially of an acrylonitrile/alkyl acrylate ester rubbery polymer/styrene resin (ASA resin), wherein said acrylonitrile/alkyl acrylate ester rubbery polymer/styrene resin comprises an alkyl acrylate ester rubbery polymer phase and an acrylonitrile-styrene copolymer phase, said acrylonitrile/alkyl acrylate ester rubbery polymer/styrene resin includes 10–35 wt % alkyl acrylate ester rubbery polymer, and said acrylonitrile-styrene copolymer phase includes 25–44 wt % acrylonitrile.

* * * * *